US009467779B2

(12) United States Patent
Iyengar et al.

(10) Patent No.: US 9,467,779 B2
(45) Date of Patent: Oct. 11, 2016

(54) MICROPHONE PARTIAL OCCLUSION DETECTOR

(71) Applicant: Apple Inc., Cupertino, CA (US)

(72) Inventors: Vasu Iyengar, Pleasanton, CA (US); Fatos Myftari, San Jose, CA (US); Sorin V. Dusan, San Jose, CA (US); Aram M. Lindahl, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 226 days.

(21) Appl. No.: 14/276,988

(22) Filed: May 13, 2014

(65) Prior Publication Data

US 2015/0334489 A1 Nov. 19, 2015

(51) Int. Cl.

*H04R 3/04* (2006.01)
*H04R 3/00* (2006.01)
*H04R 1/08* (2006.01)

(52) U.S. Cl.

CPC *H04R 3/04* (2013.01); *H04R 1/08* (2013.01); *H04R 3/002* (2013.01); *H04R 3/005* (2013.01); *H04R 2499/11* (2013.01)

(58) Field of Classification Search

CPC ..... H04R 3/04
See application file for complete search history.

(56) References Cited

U.S. PATENT DOCUMENTS

| | | | |
|---|---|---|---|
| 6,898,566 | B1 | 5/2005 | Benyassine et al. |
| 6,963,649 | B2 | 11/2005 | Vaudrey et al. |
| 7,536,301 | B2 | 5/2009 | Jaklitsch et al. |
| 7,761,106 | B2 | 7/2010 | Konchitsky |
| 8,019,091 | B2 | 9/2011 | Burnett et al. |
| 8,046,219 | B2 | 10/2011 | Zurek et al. |
| 8,068,619 | B2 | 11/2011 | Zhang et al. |
| 8,194,882 | B2 | 6/2012 | Every et al. |
| 8,204,252 | B1 | 6/2012 | Avendano |
| 8,204,253 | B1 | 6/2012 | Solbach |
| 8,275,609 | B2 | 9/2012 | Wang |
| 8,374,362 | B2 | 2/2013 | Ramakrishnan et al. |
| 8,401,178 | B2 | 3/2013 | Chen et al. |

(Continued)

OTHER PUBLICATIONS

Jeub, Marco , et al., "Noise Reduction for Dual-Microphone Mobile Phones Exploiting Power Level Differences", *Acoustics, Speech and Signal Processing* (*ICASSP*), *2012 IEEE International Conference*, Mar. 25-30, 2012, ISSN: 1520-6149, E-ISBN: 978-1-4673-0044-5, pp. 1693-1696.

(Continued)

*Primary Examiner* — Paul Huber
(74) *Attorney, Agent, or Firm* — Blakely, Sokoloff, Taylor & Zafman LLP

(57) ABSTRACT

Digital signal processing for microphone partial occlusion detection is described. In one embodiment, an electronic system for audio noise processing and for noise reduction, using a plurality of microphones, includes a first noise estimator to process a first audio signal from a first one of the microphones, and generate a first noise estimate. The electronic system also includes a second noise estimator to process the first audio signal, and a second audio signal from a second one of the microphones, in parallel with the first noise estimator, and generate a second noise estimate. A microphone partial occlusion detector determines a low frequency band separation of the first and second audio signals and a high frequency band separation of the first and second audio signals to generate a microphone partial occlusion function that indicates whether one of the microphones is partially occluded.

20 Claims, 11 Drawing Sheets

(56) References Cited

U.S. PATENT DOCUMENTS

| | | | | |
|---|---|---|---|---|
| 8,521,530 | B1 | 8/2013 | Every et al. | |
| 9,100,756 | B2 | 8/2015 | Dusan et al. | |
| 9,215,527 | B1 | 12/2015 | Saric et al. | |
| 2004/0181397 | A1 | 9/2004 | Gao | |
| 2007/0230712 | A1 | 10/2007 | Belt et al. | |
| 2007/0237339 | A1 | 10/2007 | Konchitsky | |
| 2007/0274552 | A1 | 11/2007 | Konchitsky et al. | |
| 2008/0201138 | A1 | 8/2008 | Visser et al. | |
| 2009/0190769 | A1 | 7/2009 | Wang et al. | |
| 2009/0196429 | A1* | 8/2009 | Ramakrishnan | H04R 3/005 381/26 |
| 2009/0220107 | A1* | 9/2009 | Every | G10L 21/0208 381/94.7 |
| 2010/0081487 | A1 | 4/2010 | Chen et al. | |
| 2010/0091525 | A1 | 4/2010 | Lalithambika et al. | |
| 2010/0100374 | A1 | 4/2010 | Park et al. | |
| 2011/0106533 | A1 | 5/2011 | Yu | |
| 2011/0317848 | A1* | 12/2011 | Ivanov | H04R 3/005 381/94.2 |
| 2012/0121100 | A1 | 5/2012 | Zhang et al. | |
| 2012/0130713 | A1 | 5/2012 | Shin et al. | |
| 2012/0185246 | A1 | 7/2012 | Zhang et al. | |
| 2012/0209601 | A1 | 8/2012 | Jing | |
| 2012/0310640 | A1 | 12/2012 | Kwatra et al. | |
| 2013/0054231 | A1 | 2/2013 | Jeub et al. | |
| 2013/0282372 | A1 | 10/2013 | Visser et al. | |
| 2013/0329895 | A1 | 12/2013 | Dusan et al. | |
| 2013/0332157 | A1 | 12/2013 | Iyengar et al. | |
| 2014/0126745 | A1 | 5/2014 | Dickins et al. | |
| 2015/0110284 | A1 | 4/2015 | Niemisto et al. | |
| 2015/0221322 | A1 | 8/2015 | Iyengar et al. | |

OTHER PUBLICATIONS

Khoa, Pham C., "Noise Robust Voice Activity Detection", Nanyang Technological University, School of Computer Engineering, a thesis, 2012, Admitted Prior Art, Title page, pp. i-ix, and pp. 1-26.

Schwander, Teresa , et al., "Effect of Two-Microphone Noise Reduction on Speech Recognition by Normal-Hearing Listeners", *Journal of Rehabilitation Research and Development*, vol. 24, No. 4, Fall 1987, pp. 87-92.

Tashev, Ivan , et al., "Microphone Array for Headset with Spatial Noise Suppressor", Microsoft Research, One Microsoft Way, Redmond, WA, USA, In *Proceedings of Ninth International Workshop on Acoustics, Echo and Noise Control*, Sep. 2005, 4 pages.

Verteletskaya, Ekaterina , et al., "Noise Reduction Based on Modified Spectral Subtraction Method", *IAENG International Journal of Computer Science*, 38:1, IJCS 38 1 10, (Advanced online publication: Feb. 10, 2011), 7 pages.

Widrow, Bernard , et al., "Adaptive Noise Cancelling: Principles and Applications", *Proceedings of the IEEE*, vol. 63, No. 12, Dec. 1975, ISSN: 0018-9219, pp. 1692-1716 and 1 additional page.

"Sound Basics", *Acoustic and vibrations*, Internet document at: http://www.acousticvibration.com/sound-basis.htm, Admitted Prior Art, 3 pages, Dec. 30, 2013.

Nemer, Elias, "Acoustic Noise Reduction for Mobile Telephony", *Nortel Networks, Admitted Prior Art*, 18 pages, Jan. 2000.

* cited by examiner

MICROPHONE PARTIAL OCCLUSION DETECTOR

FIELD

An embodiment of the invention is related to digital signal processing techniques for automatically detecting that a microphone has been partially occluded, and using such a finding to modify a noise estimate that is being computed based on signals from the microphone and from another microphone. Other embodiments are also described.

BACKGROUND

Mobile phones enable their users to conduct conversations in many different acoustic environments. Some of these are relatively quiet while others are quite noisy. There may be high background or ambient noise levels, for instance, on a busy street or near an airport or train station. To improve intelligibility of the speech of the near-end user as heard by the far-end user, an audio signal processing technique known as ambient noise suppression can be implemented in the mobile phone. During a mobile phone call, the ambient noise suppressor operates upon an uplink signal that contains speech of the near-end user and that is transmitted by the mobile phone to the far-end user's device during the call, to clean up or reduce the amount of the background noise that has been picked up by the primary or talker microphone of the mobile phone. There are various known techniques for implementing the ambient noise suppressor. For example, using a second microphone that is positioned and oriented to pickup primarily the ambient sound, rather than the near-end user's speech, the ambient sound signal is electronically subtracted from the talker signal and the result becomes the uplink. In another technique, the talker signal passes through an attenuator that is controlled by a voice activity detector, so that the talker signal is attenuated during time intervals of no speech, but not in intervals that contain speech. A challenge is in how to respond when one of the microphones is partially occluded, e.g. by accident when the user partially covers one.

SUMMARY

An electronic audio processing system is described that uses multiple microphones, e.g. for purposes of noise estimation and noise reduction. A microphone occlusion detector generates a partial occlusion signal, which may be used to adjust a calculation of the noise estimate. In particular, the occlusion detection may be used to select a 1-mic noise estimate, instead of a 2-mic noise estimate, when the partial occlusion signal indicates that a second microphone is occluded. This helps maintain proper noise suppression even when a user's finger, hand, ear, face, or any object (e.g., protective cover or casing for a device) has inadvertently partially occluded the second microphone, during speech activity, and during no speech but high background noise levels. The microphone occlusion detectors may also be used with other audio processing systems that rely on the signals from at least two microphones.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
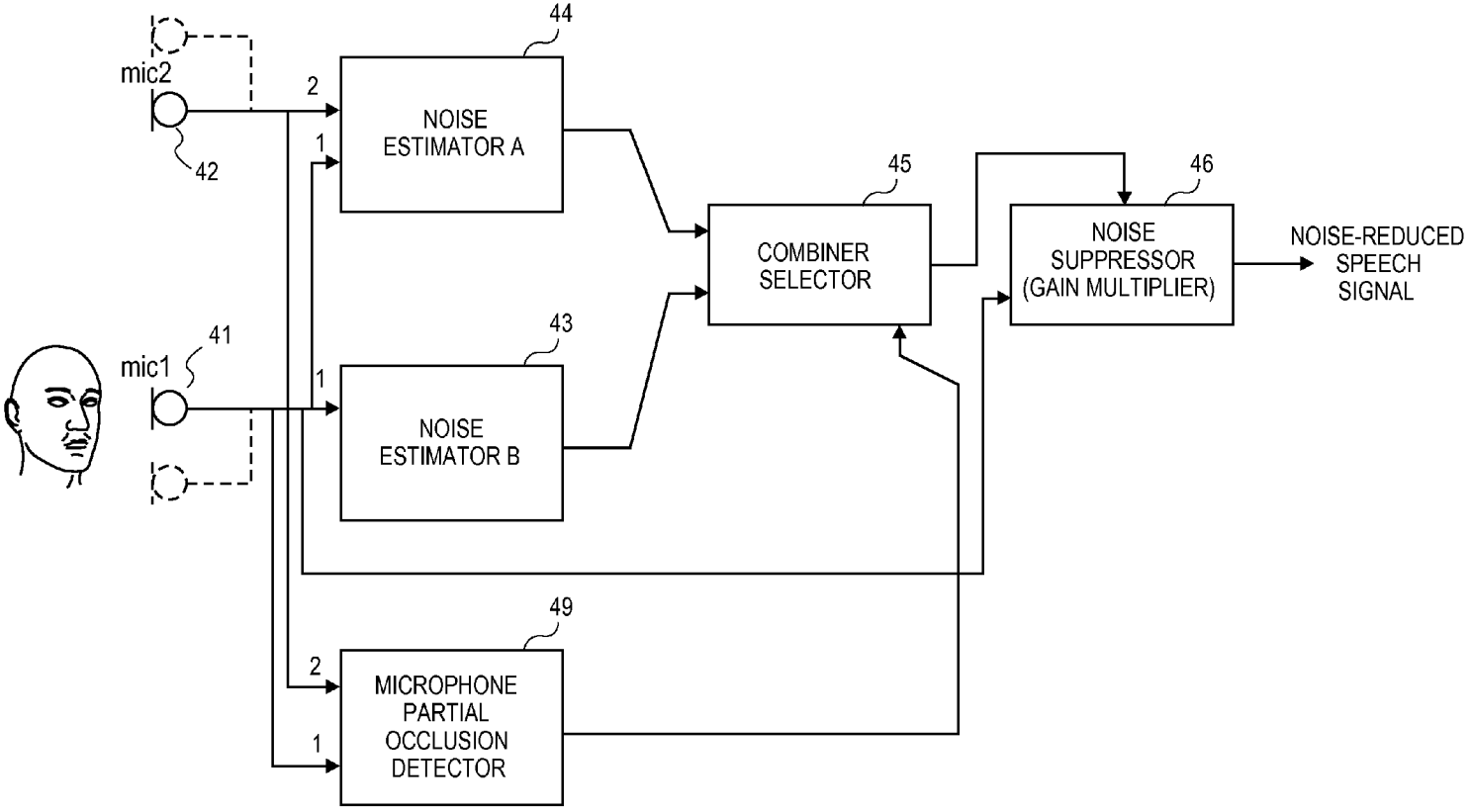
FIG. 1A is a block diagram of an electronic system for audio noise processing and noise reduction using multiple microphones in accordance with one embodiment.

FIG. 1A is a block diagram of an electronic system for audio noise processing and noise reduction using multiple microphones in accordance with one embodiment. In one embodiment, the functional blocks depicted in FIG. 1A refer to programmable digital processors or hardwired logic processors that operate upon digital audio streams. In this example, there are two microphones 41, 42 that produce the digital audio streams. The microphone 41 (mic1) may be a primary microphone or talker microphone, which is closer to the desired sound source than the microphone 42 (mic2). The latter may be referred to as a secondary microphone, and is in most instances located farther away from the desired sound source than mic1. Examples of such microphones may be found in a variety of different user audio devices. Examples include a mobile phone—see FIG. 10 or a wireless headset—see FIG. 9. Both microphones 41, 42 are expected to pick up some of the ambient or background acoustic noise that surrounds the desired sound source albeit mic1 is expected to pick up a stronger version of the desired sound. In one case, the desired sound source is the mouth of a person who is talking thereby producing a speech or talker signal, which is also corrupted by the ambient acoustic noise.

There are two audio or recorded sound channels shown, for use by various component blocks of the noise reduction (also referred to as noise suppression) system. Each of these channels carries the audio signal from a respective one of the two microphones 41, 42. It should be recognized however that a single recorded (or digitized) sound channel could also be obtained by combining the signals of multiple microphones, such as via beamforming. This alternative is depicted in the figure by the additional microphones and their connections in dotted lines. It should also be noted that in one approach, all of the processing depicted in FIG. 1A is performed in the digital domain, based on the audio signals in the two channels being discrete time sequences. Each sequence of audio data may be arranged as a series of frames, where all of the frames in a given sequence may or may not have the same number of samples.

A pair of noise estimators 43, 44 operate in parallel to generate their respective noise estimates, by processing the two audio signals from mic1 and mic2. The noise estimator 43 is also referred to as noise estimator B, whereas the noise estimator 44 can be referred to as noise estimator A. In one instance, the estimator A performs better than the estimator B in that it is more likely to generate a more accurate noise estimate, while the microphones are picking up a near-end-user's speech and non-stationary background acoustic noise during a mobile phone call.

In one embodiment, for stationary noise, such as noise that is heard while riding in a car (which may include a combination of exhaust, engine, wind, and tire noise), the two estimators A, B should provide, for the most part, similar estimates. However, in some instances there may be more spectral detail provided by the estimator A, which may be due to a better voice activity detector, VAD, being used as described below, and the ability to estimate noise even during speech activity. On the other hand, when there are significant transients in the noise, such as babble (e.g., in a crowded room) and road noise (that is heard when standing next to a road on which cars are driving by), the estimator A can be more accurate in that case because it is using two microphones. That is because in estimator B, some transients could be interpreted as speech, thereby excluding them (erroneously) from the noise estimate.

In one embodiment, estimator A may be deemed more accurate in estimating non-stationary noises than estimator B (which may essentially be a stationary noise estimator). Estimator A might also misidentify more speech as noise, if there is not a significant difference in voice power between a primarily voice signal at mic1 (41) and a primarily noise signal at mic2 (42). This can happen, for example, if the talker's mouth is located the same distance from each microphone. In one embodiment of the invention, the sound pressure level (SPL) of the noise source is also a factor in determining whether estimator A is more accurate than estimator B—above a certain (very loud) level, estimator A may be less accurate at estimating noise than estimator B. In another instance, the estimator A is referred to as a 2-mic estimator, while estimator B is a 1-mic estimator, although as pointed out above the references 1-mic and 2-mic here refer to the number of input audio channels, not the actual number of microphones used to generate the channel signals.

The noise estimators A, B operate in parallel, where the term "parallel" here means that the sampling intervals or frames over which the audio signals are processed have to, for the most part, overlap in terms of absolute time. In one embodiment, the noise estimate produced by each estimator A, B is a respective noise estimate vector, where this vector has several spectral noise estimate components, each being a value associated with a different audio frequency bin. This is based on a frequency domain representation of the discrete time audio signal, within a given time interval or frame. A combiner-selector 45 receives the two noise estimates and generates a single output noise estimate. In one instance, the combiner-selector 45 combines, for example as a linear combination, its two input noise estimates to generate its output noise estimate. However, in other instances, the combiner-selector 45 may select the input noise estimate from estimator A, but not the one from estimator B, and vice-versa.

The noise estimator B may be a conventional single-channel or 1-mic noise estimator that is typically used with 1-mic or single-channel noise suppression systems. In such a system, the attenuation that is applied in the hope of suppressing noise (and not speech) may be viewed as a time varying filter that applies a time varying gain (attenuation) vector, to the single, noisy input channel, in the frequency domain. Typically, such a gain vector is based to a large extent on Wiener theory and is a function of the signal to noise ratio (SNR) estimate in each frequency bin. To achieve noise suppression, frequency bins with low SNR are attenuated while those with high SNR are passed through unaltered, according to a well know gain versus SNR curve. Such a technique tends to work well for stationary noise such as fan noise, far field crowd noise, car noise, or other relatively uniform acoustic disturbance. Non-stationary and transient noises, however, pose a significant challenge, which may be better addressed by the noise estimation and reduction system depicted in FIG. 1A which also includes the estimator A, which may be a more aggressive 2-mic estimator. In general, the embodiments of the invention described here as a whole may aim to address the challenge of obtaining better noise estimates, both during noise-only conditions and noise+speech conditions, as well as for noises that include significant transients.

Still referring to FIG. 1A, the output noise estimate from the combiner-selector 45 is used by a noise suppressor (gain multiplier/attenuator) 46, to attenuate the audio signal from microphone 41. The action of the noise suppressor 46 may be in accordance with a conventional gain versus SNR curve, where typically the attenuation is greater when the noise estimate is greater. The attenuation may be applied in the frequency domain, on a per frequency bin basis, and in accordance with a per frequency bin noise estimate which is provided by the combiner-selector 45.

Each of the estimators 43, 44, and therefore the combiner-selector 45, may update its respective noise estimate vector in every frame, based on the audio data in every frame, and on a per frequency bin basis. The spectral components within the noise estimate vector may refer to magnitude, energy, power, energy spectral density, or power spectral density, in a single frequency bin.

One of the use cases of the user audio device is during a mobile phone call, where one of the microphones, in particular mic2, can become partially occluded, due to the user's finger, hand, ear, face or any object for example covering an acoustic port in the housing of the handheld mobile device. The partial occlusion causes a severe distortion of the detected voice signal if the partially occluded mic2 is used as a noise reference. Thus, it is important to detect the partial occlusion and revert back to a noise suppression mode that does not use the partially occluded mic. Therefore, at that point, the system should automatically switch to or rely more strongly on the 1-mic estimator B (instead of the 2-mic estimator A). This may be achieved by adding a microphone partial occlusion detector 49 whose output generates a microphone partial occlusion signal that represents a measure of how severely, or how likely it is that, one of the microphones is partially occluded. The combiner-selector 45 is modified to respond to the partial occlusion signal by accordingly changing its output noise estimate. For example, the combiner-selector 45 selects the first noise estimate (1-mic estimator B) for its output noise estimate, and not the second noise estimate (2-mic estimator A), when the partial occlusion signal crosses a threshold indicating that the second one of the microphones (here, mic 42) is partially occluded or is more occluded. The combiner-selector 45 can return to selecting the 2-mic estimator A for its output, once the partial occlusion has been removed, with the understanding that a different partial occlusion signal threshold may be used in that case (so as to employ hysteresis corresponding to a few dBs for instance) to avoid oscillations.

Figure 1B:
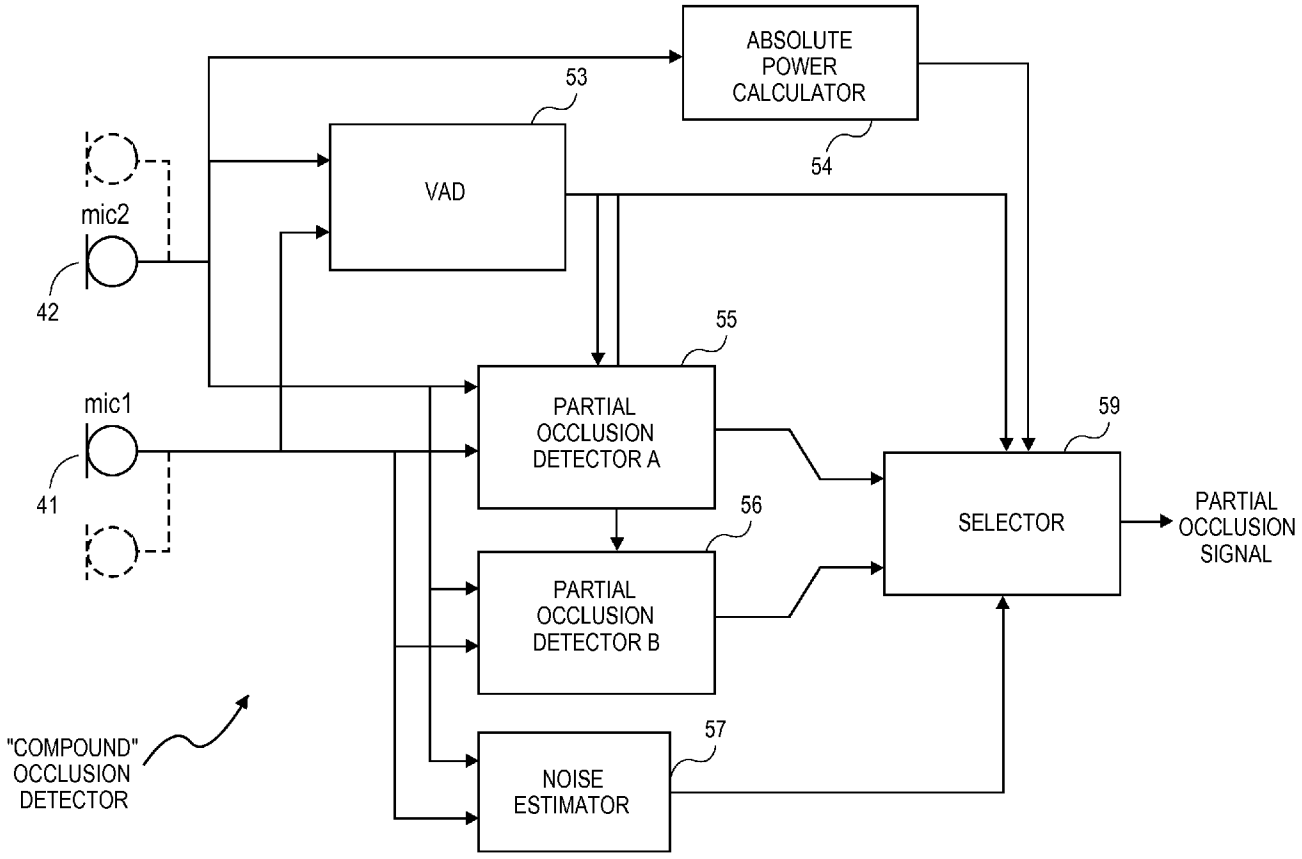
FIG. 1B, a microphone partial occlusion detector that uses multiple occlusion component functions is shown in accordance with one embodiment.

Referring now to FIG. 1B, a microphone partial occlusion detector that uses multiple occlusion component functions is shown in accordance with one embodiment. In this example, a voice activity detector (VAD) 53 processes the first and second audio signals that are from mic1 and mic2, respectively, to generate a VAD decision. A first occlusion component function is evaluated by the occlusion detector A, that represents a measure of how severely or how likely it is that the second microphone (mic 2) is partially occluded, when the VAD decision is 0 (no speech is present). A second occlusion component function is evaluated by the occlusion detector B, that represents a measure of how severely or how likely it is that the second microphone is partially occluded when the VAD decision is 1 (speech is present. The selector 59 picks between the first and second occlusion component signals as a function of the levels of speech and background noise being picked up by the microphones, e.g. as reported by the VAD 53 and/or as indicated by computing the absolute power of the signal from mic2 (absolute power calculator 54), and/or by a background noise estimator 57.

The partial occlusion detectors A, B may have different thresholds (inflection points), so that one of them is better suited to detect occlusions in a no speech condition in which the level of background noise is at a low or mid level, while the other can better detect occlusions in either a) a no speech condition in which the background noise is at a high level or b) in a speech condition.

In one embodiment, an electronic system for audio noise processing and for noise reduction, using a plurality of microphones includes a first noise estimator to process a first audio signal from a first one of the microphones and to generate a first noise estimate. A second noise estimator processes the first audio signal and a second audio signal from a second one of the microphones, in parallel with the first noise estimator, and generates a second noise estimate. A microphone partial occlusion detector determines a low frequency band separation of the signals and a high frequency band separation of the signals to generate a microphone partial occlusion function that indicates whether one of the microphones is partially occluded. The microphone partial occlusion detector compares the high frequency band separation of the signals and the low frequency band separation of the signals. The microphone partial occlusion function takes on a high value that indicates partial occlusion when a difference between the high frequency band separation of the signals and the low frequency band separation of the signals is greater than a threshold. The microphone partial occlusion function takes on a low value that indicates no partial occlusion when the difference is less than the threshold. The first and second audio signals are converted from a time domain to a frequency domain to generate a measure of strength (e.g., power, energy) of the first audio signal (e.g., power spectrum of first signal, herein after "ps_first signal") and a measure of strength of the second audio signal (e.g., power spectrum of second signal, herein after "ps_second signal"). The low band frequency separation is computed with the following equation:

$$SEP\text{lowband}=1/M[\text{summation of } k=1 \text{ to } M \text{ bins}][10*\log 10\{[ps_\text{first signal}(k)\}-10*\log 10\{[ps_\text{second signal}(k)]\}]$$

where M is a frequency bin closest to an arbitrary frequency (e.g., 0.5-3 KHz, 0.8 KHz, 0.9 KHz, 1 KHz, 1.1 KHz, 1.2 KHz, etc.) that depends upon a form factor of a device.

In one embodiment, M is a frequency bin closest to 1 KHz.

The high band frequency separation is computed with the following equation:

$$SEP\text{highband}=(1/(N-M))[\text{summation of } k=M+1 \text{ to } N \text{ bins}][10*\log 10\{[ps_\text{first signal}(k)\}-10*\log 10\{[ps_\text{second signal}(k)]\}]$$

where M is a frequency bin closest to an arbitrary frequency (e.g., 0.5-3 KHz, 0.8 KHz, 0.9 KHz, 1 KHz, 1.1 KHz, 1.2 KHz, etc.) that depends upon a form factor of a device.

In one embodiment, M is a frequency bin closest to 1 KHz.

The system further includes a combiner-selector to receive the first and second noise estimates, and to generate an output noise estimate using the first and second noise estimates. The combiner-selector generates its output noise estimate also based on the microphone partial occlusion function. The combiner-selector selects the first noise estimate for its output noise estimate, and not the second noise estimate, when the microphone partial occlusion function indicates that the second one of the microphones is partially occluded.

Figure 2:
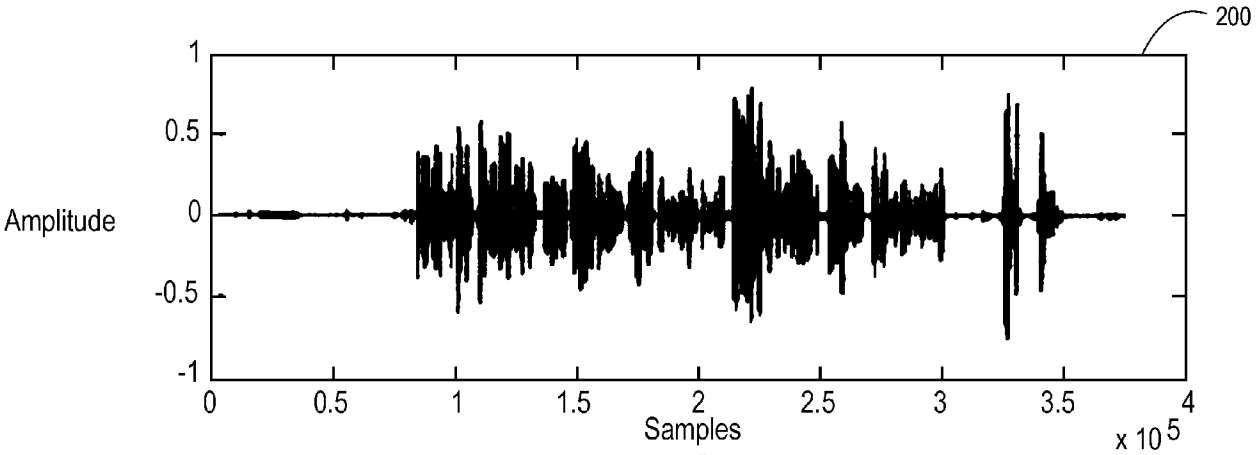
FIG. 2 illustrates a plot 200 of amplitude of a first audio signal (e.g., mic1) on a sample by sample basis in accordance with one embodiment.
Figure 3:
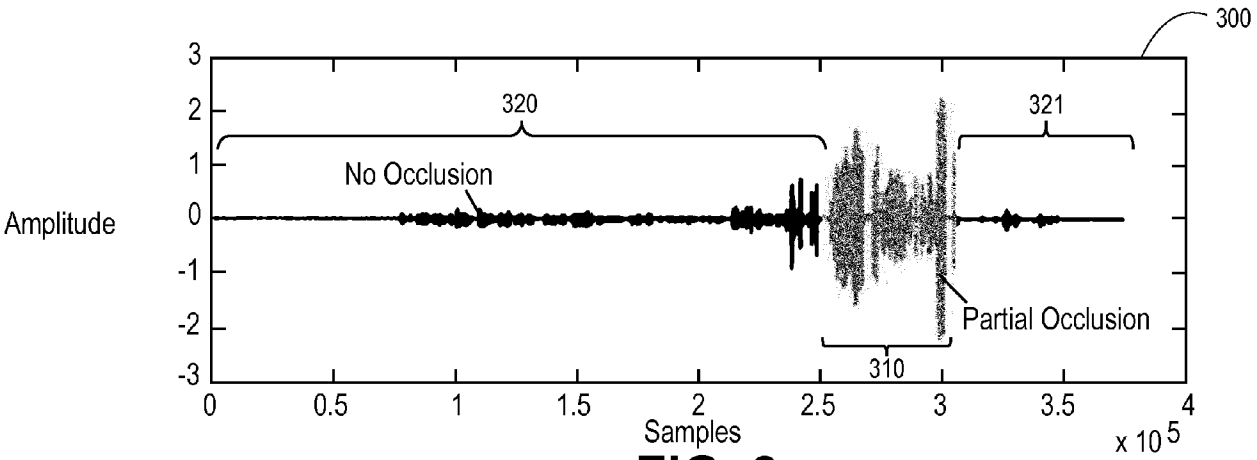
FIG. 3 illustrates a plot 300 of amplitude of a second audio signal (e.g., mic2) on a sample by sample basis with no occlusion for a first portion 320 of the signal and with partial occlusion for a second portion 310 of the signal in accordance with one embodiment.

FIG. 2 illustrates a plot 200 of amplitude of a first audio signal (e.g., mic1) on a sample by sample basis in accordance with one embodiment. FIG. 3 illustrates a plot 300 of amplitude of a second audio signal (e.g., mic2) on a sample by sample basis with no occlusion for a first portion 320 and a third portion 321 of the signal and with partial occlusion for a second portion 310 of the signal in accordance with one embodiment. The samples approximately near 2.5 to 3 ($\times 10^5$) are the second portion of the signal subject to partial occlusion. When there is a partial occlusion, there is generally an amplification of the signal below 1 KHz due to a cavity resonance effect and an attenuation of the signal in the higher frequencies beyond 1 KHz.

In one embodiment of the invention, in the microphone partial occlusion detector 49, the first and second audio signals from mic1 and mic2, respectively, are processed and converted from a time domain to a frequency domain to compute a measure of strength (e.g., power spectra (generically referred to here as "ps_first signal" and "ps_second signal")), such as in dB, of two microphone output (audio) signals $x_1$ and $x_2$. A fast fourier transform (FFT) and raw power spectra are computed. The power spectra of the first signal (e.g., mic1) and the second signal (e.g., mic2) are vectors containing the powers for all the frequency bins. Thus, "ps_first signal(k)" and "ps_second signal(k)" is the power in the k-th frequency bin. The following vector is used as a measure of separation between the first signal (e.g., mic1) and the second signal (e.g., mic2):

$$SEP=1/N[\text{summation of } k=1 \text{ to } N \text{ bins}][10*\log 10\{[ps_\text{first signal}(k)\}-10*\log 10\{[ps_\text{second signal}(k)]\}]$$

The summation occurs from k=1 to N bins for a full frequency band separation. Each input frame (or time interval) has N frequency bins and corresponds to a single data point in a time domain. Further, a low frequency band and high frequency band separation are defined with the following equations:

$$SEP\text{lowband}=1/M[\text{summation of } k=1 \text{ to } M \text{ bins}][10*\log 10\{[ps_\text{first signal}(k)\}-10*\log 10\{[ps_\text{second signal}(k)]\}]$$

$$SEP\text{highband}=(1/(N-M))[\text{summation of } k=M+1 \text{ to } N \text{ bins}][10*\log 10\{[ps_\text{first signal}(k)\}-10*\log 10\{[ps_\text{second signal}(k)]\}]$$

Where M is the frequency bin closest to an arbitrary frequency (e.g., 0.5-3 KHz, 0.8 KHz, 0.9 KHz, 1 KHz, 1.1 KHz, 1.2 KHz, etc.) that depends upon a form factor of a device. In one embodiment, M is a frequency bin closest to 1 KHz.

M depends on the sampling rate and the block size used for the FFT. For the SEPlowband each input frame has M frequency bins while for the SEPhighband each input frame has N-M frequency bins.

Next, the lowband and highband SEP are time smoothed as follows:

$$SEP\text{lowband}'=\text{alpha}*SEP\text{lowband}+(1-\text{alpha})*SEP\text{lowband}$$

$$SEP\text{highband}'=\text{alpha}*SEP\text{highband}+(1-\text{alpha})*SEP\text{highband}$$

where alpha is a smoothing factor between 0 and 1.

Figure 4:
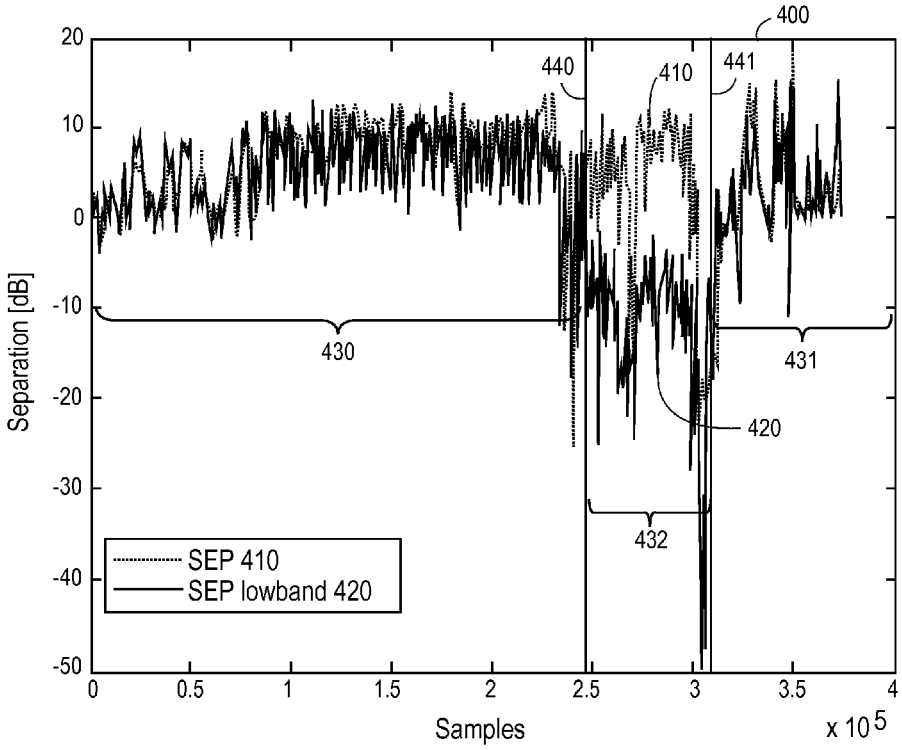
FIG. 4 illustrates a plot 400 of a time smoothed separation 410 of full band power spectra and of a time smoothed separation 420 of low frequency band power spectra of ps_first signal and ps_second signal on a sample by sample basis in accordance with one embodiment.

FIG. 4 illustrates a plot 400 of a time smoothed separation 410 of full band power spectra and a time smoothed separation 420 of low frequency band power spectra of ps_first signal and ps_second signal on a sample by sample basis in accordance with one embodiment. A first portion 430 of the low frequency band separation has no partial occlusion while a second portion 432 that is between vertical lines 440 and 441 does have partial occlusion. During no occlusion, which corresponds to the first portion 430 and a third portion 431, the low frequency band separation 420 is in general close to the full band separation 410. However, during partial occlusion the low frequency band separation, which corresponds to the second portion 432 of the low frequency band, decreases by several dB, in some cases approximately 20 dB below the full band separation 410.

Figure 5:
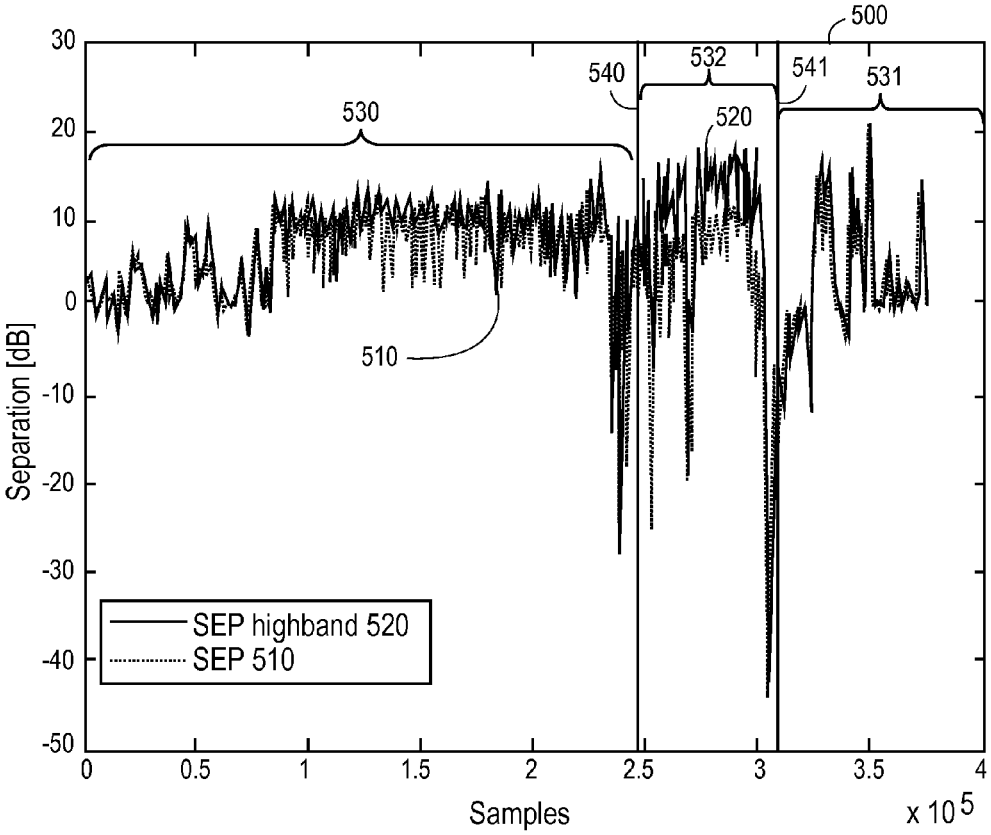
FIG. 5 illustrates a plot 500 of a time smoothed separation 510 of full band power spectra and of a time smoothed separation 520 of high frequency band power spectra of ps_first signal and ps_second signal on a sample by sample basis in accordance with one embodiment.

FIG. 5 illustrates a plot 500 of a time smoothed separation 510 of full band power spectra and a time smoothed separation 520 of high frequency band power spectra of ps_first signal and ps_second signal on a sample by sample basis in accordance with one embodiment. A first portion 530 of the high frequency band separation has no partial occlusion while a second portion 532 that is between vertical lines 540 and 541 does have partial occlusion. During no occlusion, which corresponds to the first portion 530 and a third portion 531, the high frequency band separation 520 is in general close to the full band separation 510. However, during partial occlusion the high frequency band separation, which corresponds to the second portion 532, increases by several dB, in some cases approximately 5 to 6 dB above the full band separation 510.

A partial occlusion detection function is then evaluated that is a function of a low frequency band separation and a high frequency band separation of "ps_first signal" and "ps_second signal", e.g. at the computed low frequency band separation and the high frequency band separation of "ps_first signal" and "ps_second signal" with a metric D equaling high frequency band separation minus low frequency band separation.

Figure 6:
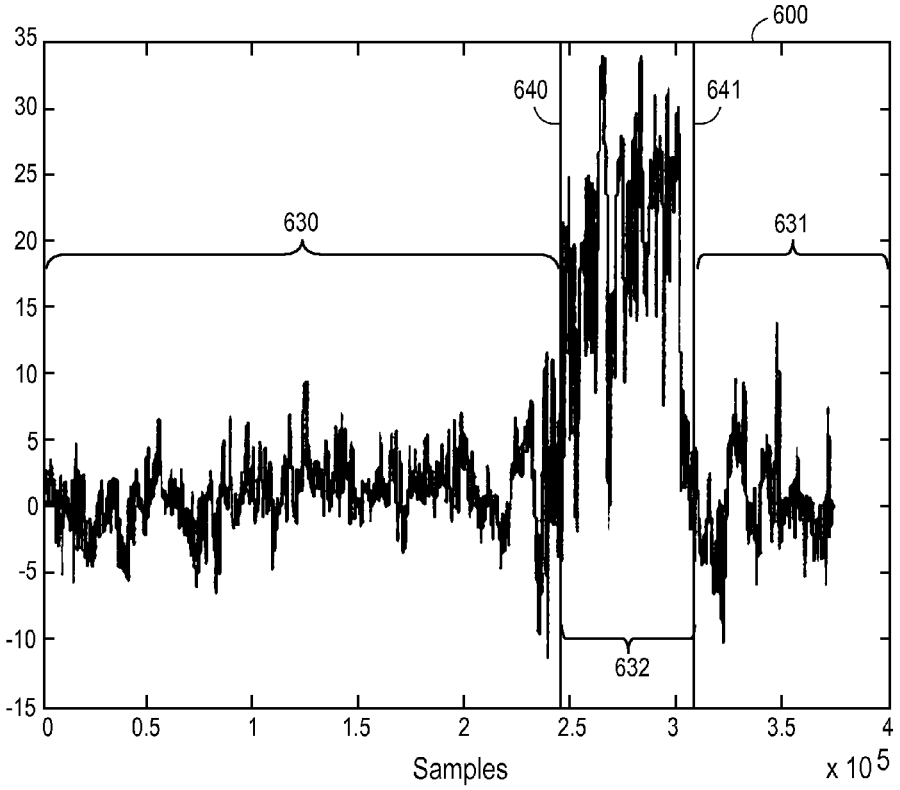
FIG. 6 illustrates a plot 600 of a partial occlusion detection function (e.g., a separation metric D) on a sample by sample basis in accordance with one embodiment.

FIG. 6 illustrates a plot 600 of a partial occlusion detection function (e.g., a separation metric D) on a sample by sample basis in accordance with one embodiment. A first portion 630 and a third portion 631 of the partial occlusion detection function (e.g., a separation metric D) has no partial occlusion while a second portion 632 that is between vertical lines 640 and 641 does have partial occlusion. Other types of occlusion functions can be employed by those of ordinary skill in the art. Generally speaking, the partial occlusion function represents a measure of how severely or how likely it is that one of the first and second microphones is partially occluded, using the processed first and second audio signals.

Figure 7:
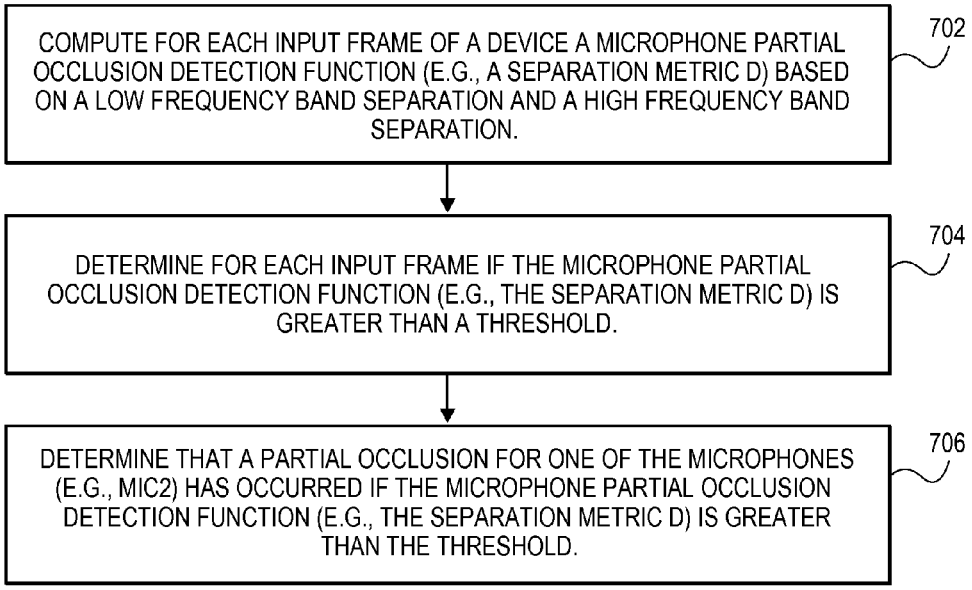
FIG. 7 illustrates a flow diagram of operations for a method of detecting a microphone partial occlusion in accordance with certain embodiments.

FIG. 7 illustrates a flow diagram of operations for a method of detecting a microphone partial occlusion in accordance with certain embodiments. The operational flow of method 700 may be executed by an apparatus or system or electronic device, which includes processing circuitry or processing logic. The processing logic may include hardware (circuitry, dedicated logic, etc.), software (such as is run on a general purpose computer system or a dedicated machine or a device), or a combination of both. In one embodiment, an electronic device performs the operations of method 700.

At operation 702, for each input frame, the device computes a microphone partial occlusion detection function (e.g., a separation metric D) based on a low frequency band separation of first and second audio output signals of first and second microphones respectively of the device and a high frequency band separation of the first and second signals. At operation 704, for each input frame, the device determines if the microphone partial occlusion detection function (e.g., the separation metric D) is greater than a threshold (e.g., a threshold value of 5 to 15 dB, a threshold value of approximately 10 dB). At operation 706, the device determines that a partial occlusion for one of the microphones (e.g., mic2) has occurred if the microphone partial occlusion detection function (e.g., the separation metric D) is greater than the threshold.

Figure 8:
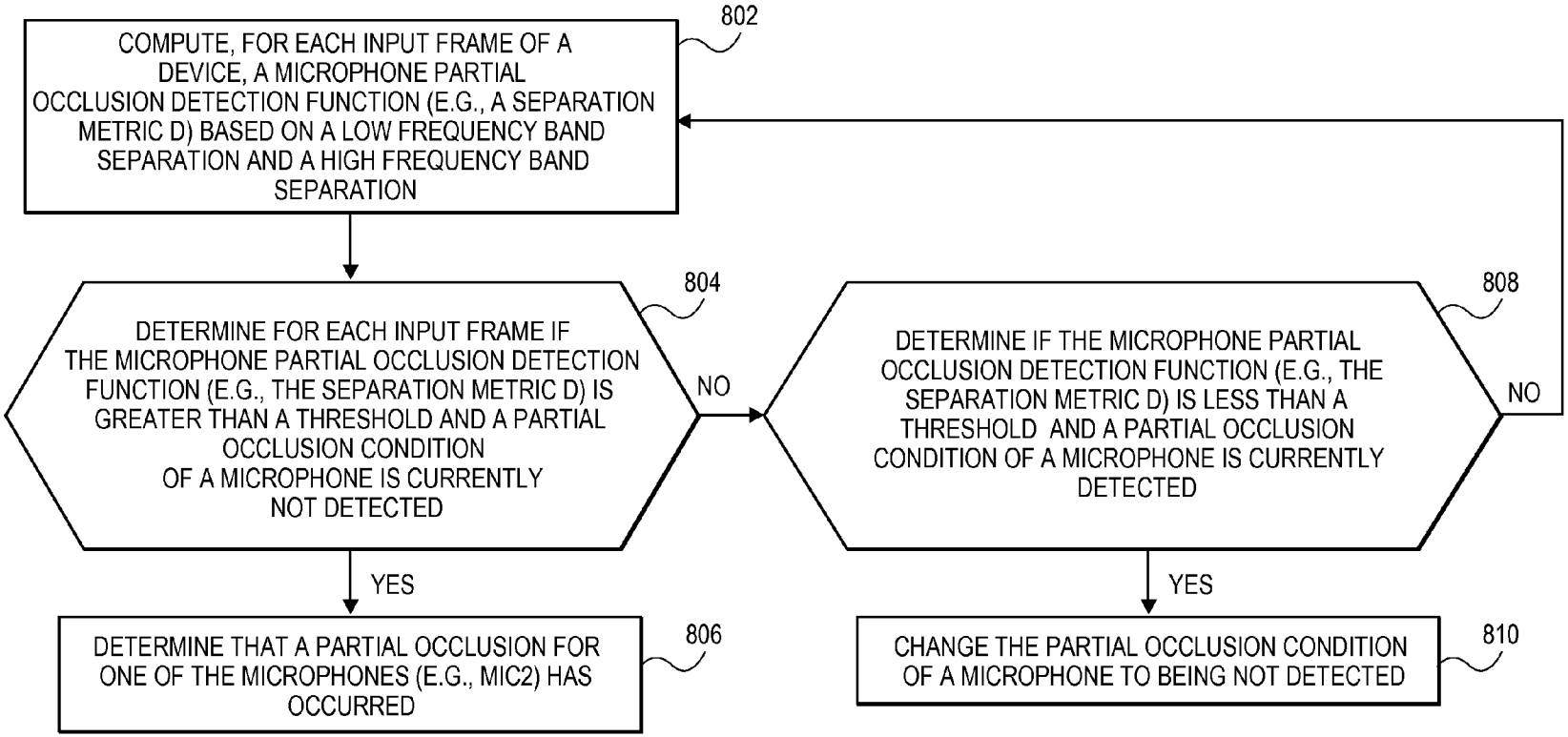
FIG. 8 illustrates a flow diagram of operations for a method of detecting a microphone partial occlusion in accordance with certain embodiments.

FIG. 8 illustrates a flow diagram of operations for a method of detecting a microphone partial occlusion in accordance with certain embodiments. The operational flow of method 800 may be executed by an apparatus or system or electronic device, which includes processing circuitry or processing logic. The processing logic may include hardware (circuitry, dedicated logic, etc.), software (such as is run on a general purpose computer system or a dedicated machine or a device), or a combination of both. In one embodiment, an electronic device performs the operations of method 800.

At operation 802, for each input frame, the device computes a microphone partial occlusion detection function (e.g., a separation metric D) based on a low frequency band separation of first and second audio output signals of first and second microphones respectively of the device and a high frequency band separation of the first and second signals. At operation 804, for each input frame, the device determines if the microphone partial occlusion detection function (e.g., the separation metric D) is greater than a threshold (e.g., a threshold value of 5 to 15 dB, a threshold value of approximately 10 dB) and a partial occlusion condition of a microphone is currently not detected. At operation 806, the device determines that a partial occlusion for one of the microphones (e.g., mic2) has occurred if the microphone partial occlusion detection function (e.g., the separation metric D) is greater than the threshold and the partial occlusion condition of a microphone is currently not detected at operation 806. Otherwise, at operation 808, for each input frame, the device determines if the microphone partial occlusion detection function (e.g., the separation metric D) is less than a threshold (e.g., a threshold value of 5 to 15 dB, a threshold value of approximately 10 dB) and a partial occlusion condition of a microphone is currently detected. If so, then at operation 810 the partial occlusion condition of a microphone is changed to being not detected. If not, then the process flow returns to operation 804.

The threshold for the methods 700 and 800 may be variable depending on conditions of use including environmental conditions (e.g., airport, noisy street, geometry of room) type of housing and spatial arrangement of the mics for the device. For example, a full band separation may typically vary from 8 to 12 dB and have a threshold set for this range in the full band separation. The threshold may be adjusted for a full band separation that is significantly different than the typical range of 8 to 12 dB.

In one embodiment, a full occlusion algorithm runs in parallel with a partial occlusion algorithm as discussed in methods 700 and 800. When any type of mic2 occlusion (e.g., full occlusion, partial occlusion) is detected, a noise suppression algorithm switches from a two mic noise estimate to using a one mic (e.g., mic1) noise estimate. The noise algorithm switches back to the two mic noise estimate when no occlusion is detected.

Figure 9:
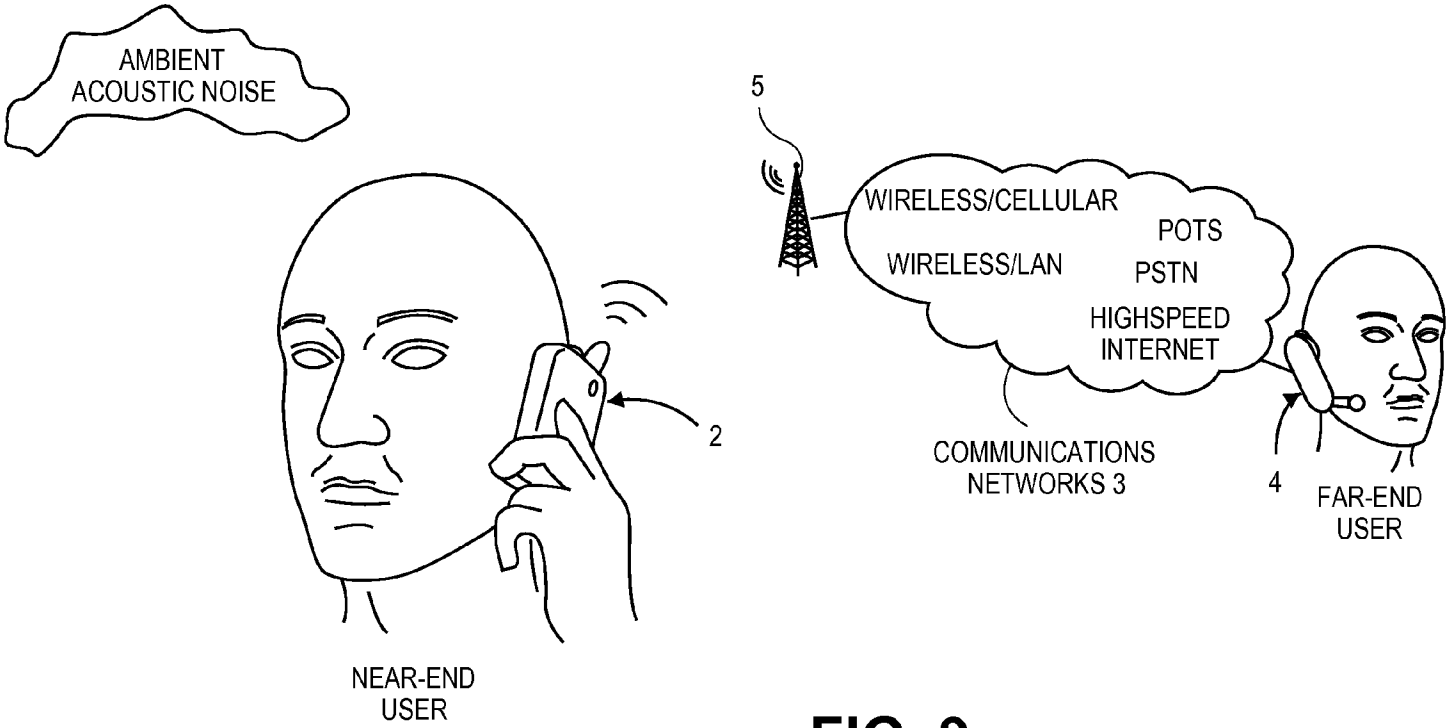
FIG. 9 depicts a mobile communications handset device in use at-the-ear during a call, by a near-end user in the presence of ambient acoustic noise in accordance with one embodiment.

FIG. 9 shows a near-end user holding a mobile communications handset device 2 such as a smart phone or a multi-function cellular phone in accordance with one embodiment. The noise estimation, partial or full occlusion detection and noise reduction or suppression techniques described above can be implemented in such a user audio device, to improve the quality of the near-end user's recorded voice. The near-end user is in the process of a call with a far-end user who is using a communications device 4 (e.g., wireless headset). The noise estimation, partial or full occlusion detection and noise reduction or suppression techniques described above also can be implemented in a communications device 4 (e.g., a wireless headset), to improve the quality of the user's recorded voice. The terms "call" and "telephony" are used here generically to refer to any two-way real-time or live audio communications session with a far-end user (including a video call which allows simultaneous audio). The term "mobile phone" is used generically here to refer to various types of mobile communications handset devices (e.g., a cellular phone, a portable wireless voice over IP device, and a smart phone). The mobile device 2 communicates with a wireless base station 5 in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device or a wireless headset, but instead may be using a landline based POTS or Internet telephony station.

Figure 10:
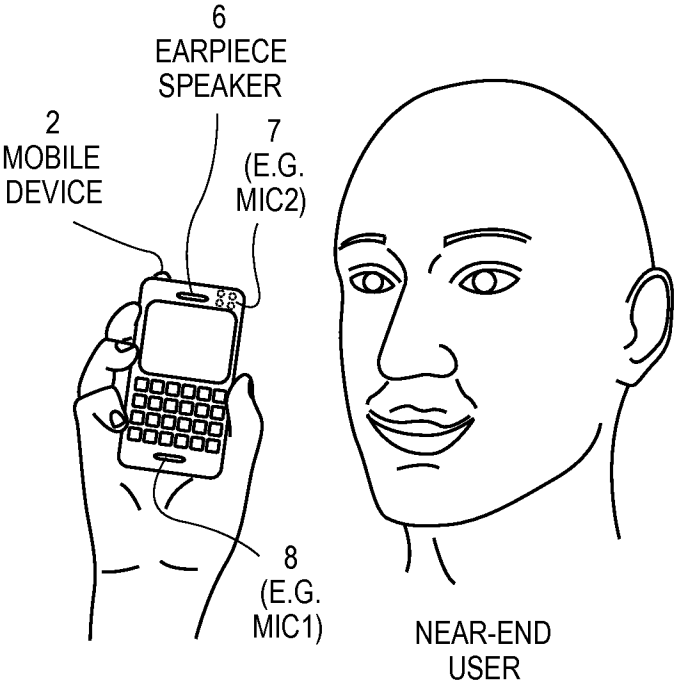
FIG. 10 depicts the user holding the mobile device away-from-the-ear during a call in accordance with one embodiment.

As seen in FIG. 10, the mobile device 2 has an exterior housing in which are integrated an earpiece speaker 6 near one side of the housing, and a primary microphone 8 (also referred to as a talker microphone, e.g. mic 1) that is positioned near an opposite side of the housing in accordance with one embodiment. The mobile device 2 may also have a secondary microphone 7 (e.g., mic 2) located on another side or on the rear face of the housing and generally aimed in a different direction than the primary microphone 8, so as to better pickup the ambient sounds. The latter may be used by an ambient noise suppressor 24 (see FIG. 11), to reduce the level of ambient acoustic noise that has been picked up inadvertently by the primary microphone 8 and that would otherwise be accompanying the near-end user's speech in the uplink signal that is transmitted to the far-end user.

Figure 11:
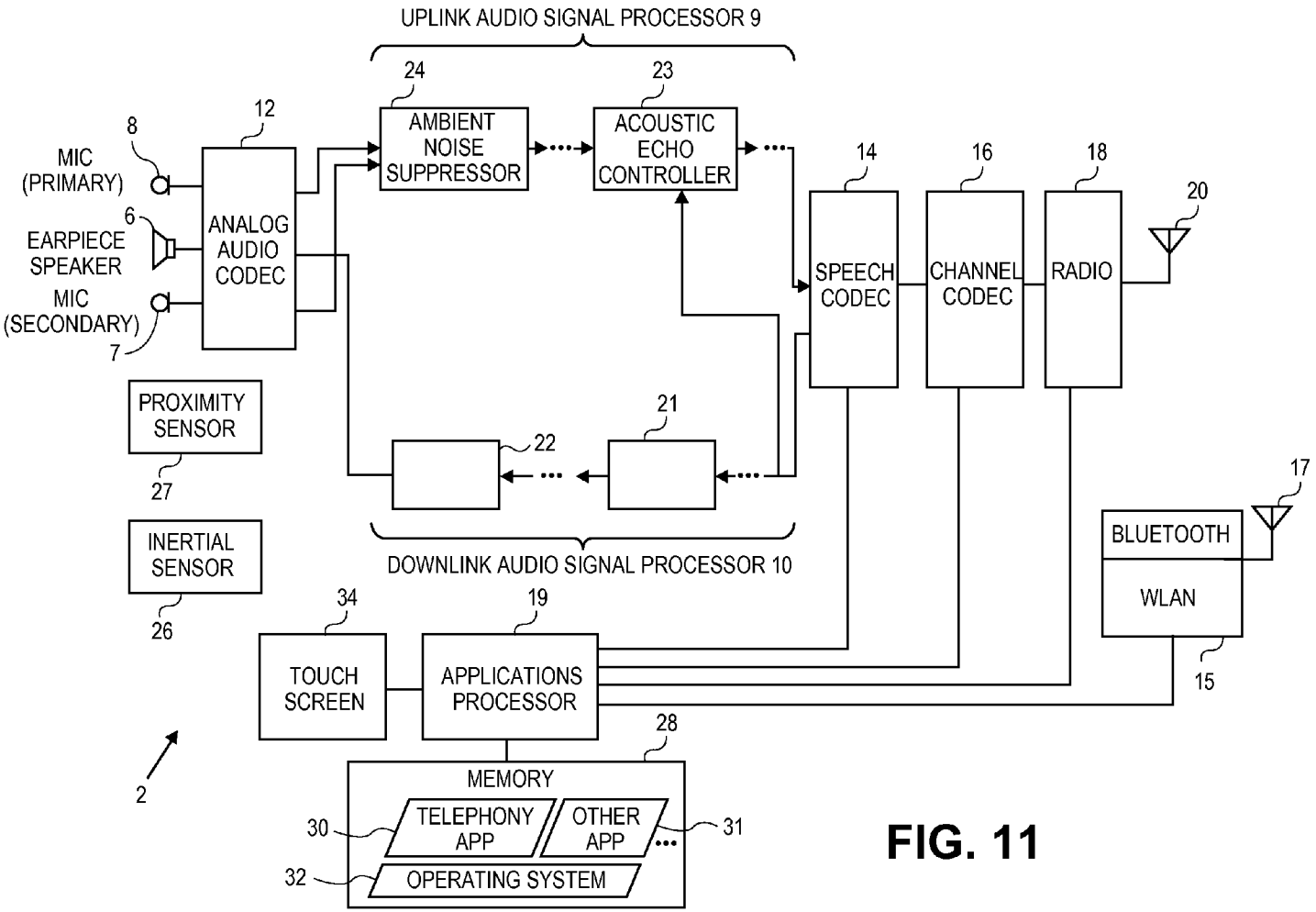
FIG. 11 is a block diagram of some of the functional unit blocks and hardware components in an example mobile device in accordance with one embodiment.

Turning now to FIG. 11, a block diagram of some of the functional unit blocks of the mobile device 2, relevant to the call enhancement process described above concerning ambient noise suppression, is shown in accordance with one embodiment. These include constituent hardware components such as those, for instance, of an iPhone™ device by Apple Inc. Although not shown, the device 2 has a housing in which the primary mechanism for visual and tactile interaction with its user is a touch sensitive display screen (touch screen 34). As an alternative, a physical keyboard may be provided together with a display-only screen. The housing may be essentially a solid volume, often referred to as a candy bar or chocolate bar type, as in the iPhone™ device. Alternatively, a moveable, multi-piece housing such as a clamshell design or one with a sliding physical keyboard may be provided. The touch screen 34 can display typical user-level functions of visual voicemail, web browser, email, digital camera, various third party applications (or "apps"), as well as telephone features such as a virtual telephone number keypad that receives input from the user via touch gestures.

The user-level functions of the mobile device 2 are implemented under the control of an applications processor 19 or a system on a chip (SoC) that is programmed in accordance with instructions (code and data) stored in memory 28 (e.g., microelectronic non-volatile random access memory). The terms "processor" and "memory" are generically used here to refer to any suitable combination of programmable data processing components and data storage that can implement the operations needed for the various functions of the device described here. An operating system 32 may be stored in the memory 28, with several application programs, such as a telephony application 30 as well as other applications 31, each to perform a specific function of the device when the application is being run or executed. The telephony application 30, for instance, when it has been launched, unsuspended or brought to the foreground, enables a near-end user of the device 2 to "dial" a telephone number or address of a communications device 4 of the far-end user (see FIG. 9), to initiate a call, and then to "hang up" the call when finished.

For wireless telephony, several options are available in the device 2 as depicted in FIG. 11. A cellular phone protocol may be implemented using a cellular radio 18 that transmits and receives to and from a base station 5 using an antenna 20 integrated in the device 2. As an alternative, the device 2 offers the capability of conducting a wireless call over a wireless local area network (WLAN) connection, using the Bluetooth/WLAN radio transceiver 15 and its associated antenna 17. The latter combination provides the added convenience of an optional wireless Bluetooth headset link. Packetizing of the uplink signal, and depacketizing of the downlink signal, for a WLAN protocol may be performed by the applications processor 19.

The uplink and downlink signals for a call that is conducted using the cellular radio 18 can be processed by a channel codec 16 and a speech codec 14 as shown. The speech codec 14 performs speech coding and decoding in order to achieve compression of an audio signal, to make more efficient use of the limited bandwidth of typical cellular networks. Examples of speech coding include half-rate (HR), full-rate (FR), enhanced full-rate (EFR), and adaptive multi-rate wideband (AMR-WB). The latter is an example of a wideband speech coding protocol that transmits at a higher bit rate than the others, and allows not just speech but also music to be transmitted at greater fidelity due to its use of a wider audio frequency bandwidth. Channel coding and decoding performed by the channel codec 16 further helps reduce the information rate through the cellular network, as well as increase reliability in the event of errors that may be introduced while the call is passing through the network (e.g., cyclic encoding as used with convolutional encoding, and channel coding as implemented in a code division multiple access, CDMA, protocol). The functions of the speech codec 14 and the channel codec 16 may be implemented in a separate integrated circuit chip, some times referred to as a baseband processor chip. It should be noted that while the speech codec 14 and channel codec 16 are illustrated as separate boxes, with respect to the applications processor 19, one or both of these coding functions may be performed by the applications processor 19 provided that the latter has sufficient performance capability to do so.

The applications processor 19, while running the telephony application program 30, may conduct the call by enabling the transfer of uplink and downlink digital audio signals (also referred to here as voice or speech signals) between itself or the baseband processor on the network side, and any user-selected combination of acoustic transducers on the acoustic side. The downlink signal carries speech of the far-end user during the call, while the uplink signal contains speech of the near-end user that has been picked up by the primary microphone 8. The acoustic transducers include an earpiece speaker 6 (also referred to as a receiver), a loud speaker or speaker phone (not shown), and one or more microphones including the primary microphone 8 that is intended to pick up the near-end user's speech primarily, and a secondary microphone 7 that is primarily intended to pick up the ambient or background sound. The analog-digital conversion interface between these acoustic transducers and the digital downlink and uplink signals is accomplished by an analog audio codec 12. The latter may also provide coding and decoding functions for preparing any data that may need to be transmitted out of the mobile device 2 through a connector (not shown), as well as data that is received into the device 2 through that connector. The latter may be a conventional docking connector that is used to perform a docking function that synchronizes the user's personal data stored in the memory 28 with the user's personal data stored in the memory of an external computing system such as a desktop or laptop computer.

Still referring to FIG. 11, an audio signal processor is provided to perform a number of signal enhancement and noise reduction operations upon the digital audio uplink and downlink signals, to improve the experience of both near-end and far-end users during a call. This processor may be viewed as an uplink processor 9 and a downlink processor 10, although these may be within the same integrated circuit die or package. Again, as an alternative, if the applications processor 19 is sufficiently capable of performing such functions, the uplink and downlink audio signal processors 9, 10 may be implemented by suitably programming the applications processor 19. Various types of audio processing functions may be implemented in the downlink and uplink signal paths of the processors 9, 10.

The downlink signal path receives a downlink digital signal from either the baseband processor (and speech codec 14 in particular) in the case of a cellular network call, or the applications processor 19 in the case of a WLAN/VOIP call. The signal is buffered and is then subjected to various functions, which are also referred to here as a chain or sequence of functions. These functions are implemented by downlink processing blocks or audio signal processors 21, 22 that may include, one or more of the following which operate upon the downlink audio data stream or sequence: a noise suppressor, a voice equalizer, an automatic gain control unit, a compressor or limiter, and a side tone mixer.

The uplink signal path of the audio signal processor 9 passes through a chain of several processors that may include an acoustic echo canceller 23, an automatic gain control block, an equalizer, a compander or expander, and an ambient noise suppressor 24. The latter is to reduce the amount of background or ambient sound that is in the talker signal coming from the primary microphone 8, using, for instance, the ambient sound signal picked up by the secondary microphone 7. Examples of ambient noise suppression algorithms are the spectral subtraction (frequency domain) technique where the frequency spectrum of the audio signal from the primary microphone 8 is analyzed to detect and then suppress what appear to be noise components, and the two microphone algorithm (referring to at least two microphones being used to detect a sound pressure difference between the microphones and infer that such is produced by speech of the near-end user rather than noise). The functional unit blocks of the noise suppression system depicted in FIG. 1 and described above, including its use of the different occlusion detectors described above, is another example of the noise suppressor 24.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the 2-mic noise estimator can also be used with multiple microphones whose outputs have been combined into a single "talker" signal, in such a way as to enhance the talkers voice relative to the background/ambient noise, for example, using microphone array beam forming or spatial filtering. This is indicated in FIG. 1, by the additional microphones in dotted lines. Lastly, while FIG. 10 shows how the occlusion detection techniques can work with a pair of microphones that are built into the housing of a mobile phone device, those techniques can also work with microphones that are positioned on a wired headset or on a wireless headset in accordance with one embodiment. The description is thus to be regarded as illustrative instead of limiting.

What is claimed is:

1. An electronic system for audio noise processing and for noise reduction, using a plurality of microphones, comprising:

a first noise estimator to process a first audio signal from a first one of the microphones, and generate a first noise estimate;

a second noise estimator to process the first audio signal, and a second audio signal from a second one of the microphones, in parallel with the first noise estimator, and generate a second noise estimate;

a microphone partial occlusion detector to determine a low frequency band separation of the first and second audio signals and a high frequency band separation of the first and second audio signals, to generate a microphone partial occlusion function that indicates whether one of the microphones is partially occluded; and a combiner-selector to receive the first and second noise estimates, and to generate an output noise estimate using the first and second noise estimates, wherein the combiner-selector is to generate its output noise estimate also based on the microphone partial occlusion function, wherein the combiner-selector selects the first noise estimate for its output noise estimate, and not the second noise estimate, when the microphone partial occlusion function indicates that the second one of the microphones is partially occluded.

2. The system of claim 1 wherein the microphone partial occlusion detector compares the high frequency band separation of the first and second audio signals and the low frequency band separation of the first and second audio signals.

3. The system of claim 2 wherein the microphone partial occlusion function takes on a value that indicates partial occlusion when a difference between the high frequency band separation of the first and second audio signals and the low frequency band separation of the first and second audio signals is greater than a threshold.

4. The system of claim 3 wherein the microphone partial occlusion function takes on another value that indicates no partial occlusion when the difference is less than the threshold.

5. The system of claim 3, wherein the first and second audio signals are converted from a time domain to a frequency domain to generate a measure of strength of the first audio signal and a measure of strength of the second audio signal.

6. The system of claim 5, wherein the low band frequency separation is computed with the following equation:

$$SEP\text{lowband}=1/M[\text{summation of } k=1 \text{ to } M \text{ bins}][10*\log 10\{[\text{ps_first signal}(k)\}-10*\log 10\{[ps_\text{second signal}(k)]\}]$$

where M is a frequency bin closest to a frequency that depends upon a form factor of the electronic system and ps_first signal and ps_second signal are computed power levels for the first and second audio signals, respectively.

7. The system of claim 5, wherein the high band frequency separation is computed with the following equation:

$$SEP\text{highband}=(1/(N-M))[\text{summation of } k=M+1 \text{ to } N \text{ bins}][10*\log 10\{[ps_\text{first signal }(k)\}-10*\log 10\{[ps_\text{second signal}(k)]\}]$$

where M is a frequency bin closest to a frequency that depends upon a form factor of the electronic system and ps_first signal and ps_second signal are computed power levels for the first and second audio signals, respectively.

8. A device having a microphone partial occlusion detector comprising:

means for processing first and second audio signals that are from first and second microphones, respectively, including means for determining a low frequency band separation of the first and second audio signals and a high frequency band separation of the first and second audio signals; and means for evaluating a microphone partial occlusion function that indicates a likelihood of a second microphone being partially occluded, using the processed first and second audio signals wherein the processing means compares a high frequency band separation of the first and second audio signals and a low frequency band separation of the first and second audio signals wherein the microphone partial occlusion function takes on a value that indicates partial occlusion when a difference between the high frequency band separation of the first and second audio signals and the low frequency band separation of the first and second audio signals is greater than a threshold.

9. The device of claim 8 wherein the microphone partial occlusion function takes on another value that indicates no partial occlusion when the difference is less than the threshold.

10. The device of claim 8, wherein the first and second audio signals are converted from a time domain to a frequency domain to generate a measure of strength of the first audio signal and a measure of strength of the second audio signal.

11. The device of claim 10, wherein the low band frequency separation is computed with the following equation:

$$SEP\text{lowband}=1/M[\text{summation of } k=1 \text{ to } M \text{ bins}][10*\log 10\{[ps_\text{first signal}(k)\}-10*\log 10\{[ps_\text{second signal}(k)]\}]$$

where M is a frequency bin closest to a frequency that depends upon a form factor of the device and ps_first signal and ps_second signal are computed power levels for the first and second audio signals, respectively.

12. The device of claim 10, wherein the high band frequency separation is computed with the following equation:

$$SEP\text{highband}=(1/(N-M))[\text{summation of } k=M+1 \text{ to } N \text{ bins}][10*\log 10\{[ps_\text{first signal }(k)\}-10*\log 10\{[ps_\text{second signal}(k)]\}]$$

where M is a frequency bin closest to a frequency that depends upon a form factor of the device and ps_first signal and ps_second signal are computed power levels for the first and second audio signals, respectively.

13. A method for detecting partial occlusion of a microphone, comprising:

computing a microphone partial occlusion function for each input frame based on a low frequency band separation of first and second audio signals of first and second microphones respectively of a device and based on a high frequency band separation of the first and second audio signals; and determining if the microphone partial occlusion function for each input frame is greater than a threshold using a partial occlusion algorithm; and determining that a partial occlusion for one of the microphones has occurred if the microphone partial occlusion detection function is greater than the threshold.

14. The method of claim 13 further comprising:

determining that no partial occlusion for the microphones has occurred if the microphone partial occlusion function is less than the threshold.

15. The method of claim 13 wherein the first and second audio signals are converted from a time domain to a frequency domain to generate a measure of strength of the first audio signal and a measure of strength of the second audio signal.

16. The method of claim 13, wherein a full occlusion algorithm runs in parallel with the partial occlusion algorithm and when any type of full or partial occlusion is detected, a noise suppression algorithm switches from a two mic noise estimate to using a one mic noise estimate.

17. A method for detecting partial occlusion of a microphone, comprising:

computing a microphone partial occlusion function based on a low frequency band separation of first and second audio signals of first and second microphones respectively of a device and based on a high frequency band separation of the first and second audio signals;

determining if the microphone partial occlusion function is greater than a threshold and a partial occlusion condition of a microphone is currently not detected;

determining that a partial occlusion for one of the microphones of the device has occurred if the microphone partial occlusion detection function is greater than the threshold and the partial occlusion condition of a microphone is currently not detected.

18. The method of claim 17, further comprising:

determining if the microphone partial occlusion detection function is less than a threshold and a partial occlusion condition of a microphone is currently detected.

19. The method of claim 18, further comprising:

changing the partial occlusion condition of a microphone to being not detected if the microphone partial occlusion detection function is less than a threshold and the partial occlusion condition of the microphone is currently detected.

20. The method of claim 17 wherein the first and second audio signals are converted from a time domain to a frequency domain to generate a measure of strength of the first audio signal and a measure of strength of the second audio signal.

* * * * *